US007584807B2

(12) United States Patent
Berger et al.

(10) Patent No.: US 7,584,807 B2
(45) Date of Patent: Sep. 8, 2009

(54) MULTIPLE PULSEJET BORING DEVICE

(75) Inventors: W. Andrew Berger, Clarks Summit, PA (US); Robert A. Spalletta, Scranton, PA (US); Jerry A. Carter, Clarks Green, PA (US); Richard M. Pell, Dalton, PA (US); Marian Mazurkiewicz, Dallas, PA (US)

(73) Assignee: The University of Scranton, Scranton, PA (US)

( * ) Notice: Subject to any disclaimer, the term of this patent is extended or adjusted under 35 U.S.C. 154(b) by 222 days.

(21) Appl. No.: 11/886,374

(22) PCT Filed: Mar. 23, 2006

(86) PCT No.: PCT/US2006/011092

§ 371 (c)(1),
(2), (4) Date: Sep. 15, 2007

(87) PCT Pub. No.: WO2006/105013

PCT Pub. Date: Oct. 5, 2006

(65) Prior Publication Data

US 2009/0057017 A1 Mar. 5, 2009

Related U.S. Application Data

(60) Provisional application No. 60/666,970, filed on Mar. 31, 2005.

(51) Int. Cl.
*E21B 7/04* (2006.01)

(52) U.S. Cl. ..... 175/14; 175/61

(58) Field of Classification Search ..... 175/11, 175/12, 14, 61
See application file for complete search history.

(56) References Cited

U.S. PATENT DOCUMENTS 3,385,381 A * 5/1968 Calaman ..... 175/14
3,476,194 A * 11/1969 Browning ..... 175/14
4,168,752 A * 9/1979 Sabol ..... 175/12

* cited by examiner

*Primary Examiner*—William P Neuder
(74) *Attorney, Agent, or Firm*—Riddle Patent Law; Charles L. Riddle, Esq.

(57) ABSTRACT

A method and device for boring a hole [5] through a material along a desired path includes an umbilical subsystem [2000] connected to a boring subsystem [3000] having a plurality of pulsejets [3100]. These pulsejets [3100] repeatedly receive and ignite a combustible fluid [7] in a combustion chamber [3230] causing a portion of the fluid [7] to be forced out of a nozzle [3260] at high speeds as a fluid slug [10] that impacts materials ahead of the pulsejet [3100]. A controller [3310] controls the amount of fluid provided to each pulsejet [3100], and the firing timing, thereby controlling the intensity in which each slug [10] impacts the material. By modulating the intensity and firing sequence of each of the pulsejets [3100], material ahead of the boring subsystem [3000] is differentially bored thereby allowing steering of the boring subsystem [3000].

20 Claims, 9 Drawing Sheets

MULTIPLE PULSEJET BORING DEVICE

CROSS REFERENCE TO RELATED APPLICATIONS

The present application claims priority from U.S. Provisional Patent Application Ser. No. 60/666,970 filed Mar. 31, 2005 entitled "The Archimedes Javelin" by Wojciech Andrew Berger, Robert A. Spalletta, Jerry A. Carter, Richard M. Pell, Marian Mazurkiewicz, Christopher Davey. The present patent Application is also related to "System for Rapidly Boring Through Materials" by Wojciech Andrew Berger, Robert A. Spalletta, Jerry A. Carter, Richard M. Pell, Marian Mazurkiewicz, and "Cryogenic Pulsejet" by Robert A. Spalletta both filed concurrently with this application. All of the above applications are hereby incorporated by reference as if set forth in its entirety herein.

BACKGROUND OF THE INVENTION

1. Field of the Invention

The present invention relates to a nozzle for boring through earth which may be steered in a desired direction.

2. Discussion of Related Art

Prior art devices which employ one or more high-pressure liquid cutting jets on a rotary cutting borehead at the end of an umbilical. At least one jet is offset from center of the borehead. The borehead is designed to be inserted into the ground and rotate while the jets are operating. The jets are timed to fire with higher pressure at a specific side of the borehead of each rotation. If timed properly, the jets would cut deeper on one side of the borehead as opposed to other sides thereby steering the borehead and umbilical toward that side.

Since borehead rotation is required, the rotating tip creates significant torques on the umbilical and other associated equipment. Due to the engineering requirements, it is doubtful if a device can be constructed using this technology for rapid boring to depths on the order of several hundred meters.

There is also the problem of pressure loss due to friction. Water or another incompressible fluid is pumped to the borehead through the umbilical. As the fluid passes through the umbilical, there are considerable frictional forces which reduce the pressure delivered at the borehead. Therefore, the pressure applied at the pump end of the umbilical must be much greater to produce adequate force at the borehead. Therefore, this technology is limited in the depth in which it can bore.

Currently, there is a need for a steerable device for quickly boring a hole to a desired destination several hundred meters away.

SUMMARY OF THE INVENTION

One embodiment of the present invention is a steerable boring device for boring a hole [5] through a material in a desired direction comprising:

a) an umbilical subsystem [2000];

b) a boring subsystem [3000] connected to the umbilical subsystem [2000] having a plurality of pulsejets [3100] for combusting and firing a fluid [7], each pulsejet [3100] having:

i. an inlet [3307] for receiving the combustible fluid [7];

ii. a combustion chamber [3230] in fluid communication with the inlet [3307] for receiving the combustible fluid [7];

iii. a valve [3207] coupled between the inlet [3307] and combustion chamber [3230] for controlling the flow of fluids [7] from the inlet [3307] into the combustion chamber [3230];

iv. a nozzle [3260] fluidically connected to the combustion chamber [3230] for accelerating and pointing fluids escaping from the combustion chamber toward said material;

v. an ignition device [3240] coupled to the combustion chamber [3230] for initiating ignition of the combustible fluid [7] when activated;

c) a controller [3310] for independently activating the valves [3207] and the ignition devices [3240] of the pulsejets [3100], thereby causing at least one pulsejet [3100] to fire with greater intensity than the remaining pulsejets [3100], thereby causing the boring device [3000] to bore a hole in a desired direction.

The present invention may also be embodied as a method of steering a boring device through a material comprising the steps of:

a) inserting [1603] a boring subsystem [3000] into said material having a plurality of pulsejets [3100] of a borehead [3200] each capable of igniting combustible fluid [7]; and b) firing the pulsejets [3100] with a differential firing intensity so as to cause the borehead [3200] to turn in a desired direction.

OBJECTS OF THE INVENTION

It is an object of the present invention to provide a steerable boring device that is able to rapidly bore a hole to a desired location.

It is another object of the present invention to provide a device which rapidly bores a hole around underground obstructions.

It is another object of the present invention to provide a boring device that can interactively adjust its direction to bore a hole in a desired direction.

BRIEF DESCRIPTION OF THE DRAWINGS

The advantages of the instant disclosure will become more apparent when read with the specification and the drawings, wherein.

FIGS. **6*a*-6*h* are time-sequenced illustrations showing the functioning of pulsejet 3100**.

Figure 3:
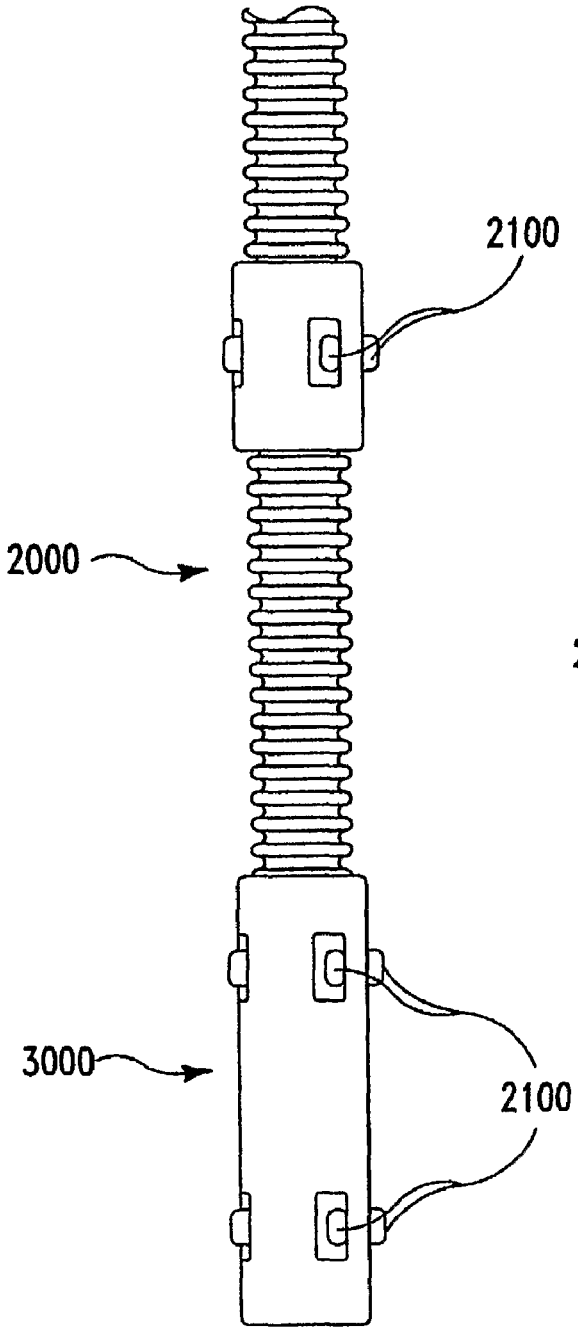
FIG. 3 is a side elevational view of an embodiment of the umbilical subsystem and the boring subsystem of the embodiment of FIGS. 1 and 2.
Figure 4:
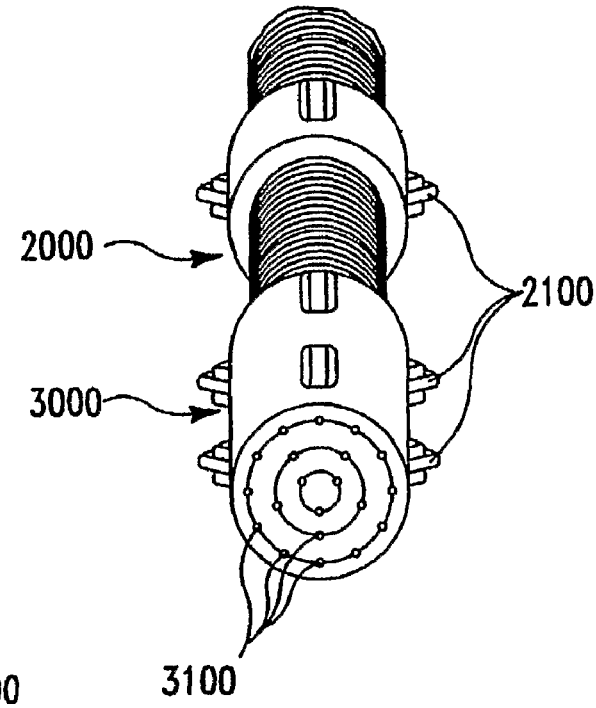
FIG. 4 is a perspective view of the umbilical subsystem and the boring subsystem of FIGS. 1-3.
Figure 5:
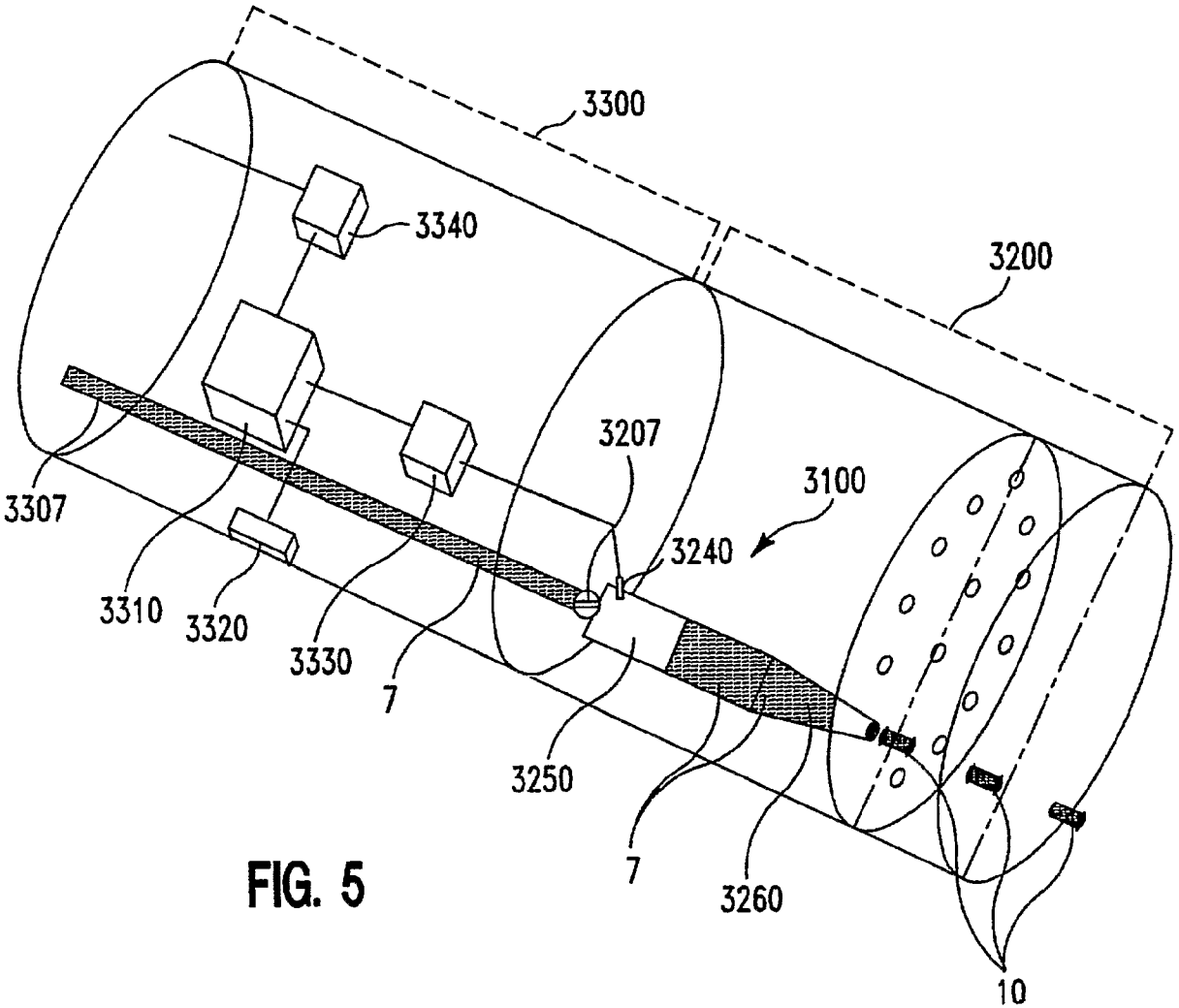
FIG. 5 is an enlarged perspective view of one embodiment of a boring subsystem 3000 according to the present invention.
Figure 7:
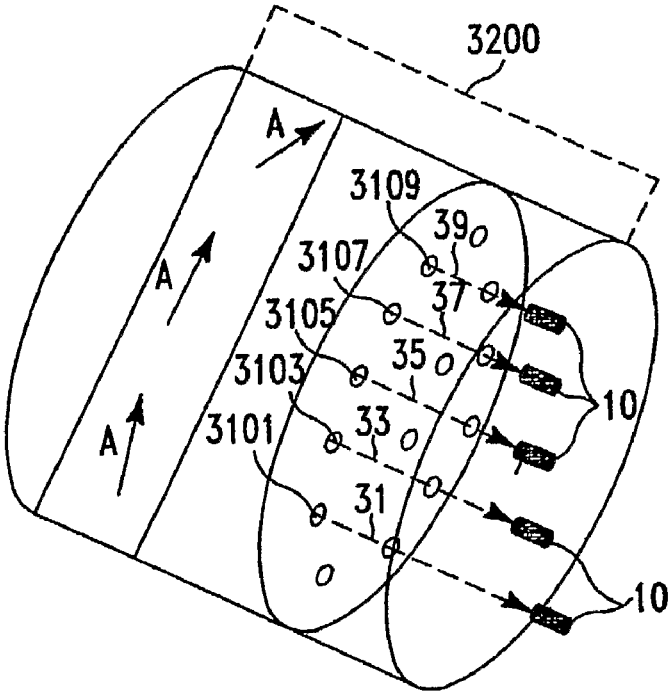

FIG. 7 is an illustration of the borehead of FIGS. 3, 4 and 5 sequentially firing pulsejets around the periphery of the borehead to create the effects of rotary boring and maximize boring efficiency.

FIG. **8*a*-8*c*** are illustrations of different sized slugs and different spacing between the slugs created by the present invention.

Figure 9:
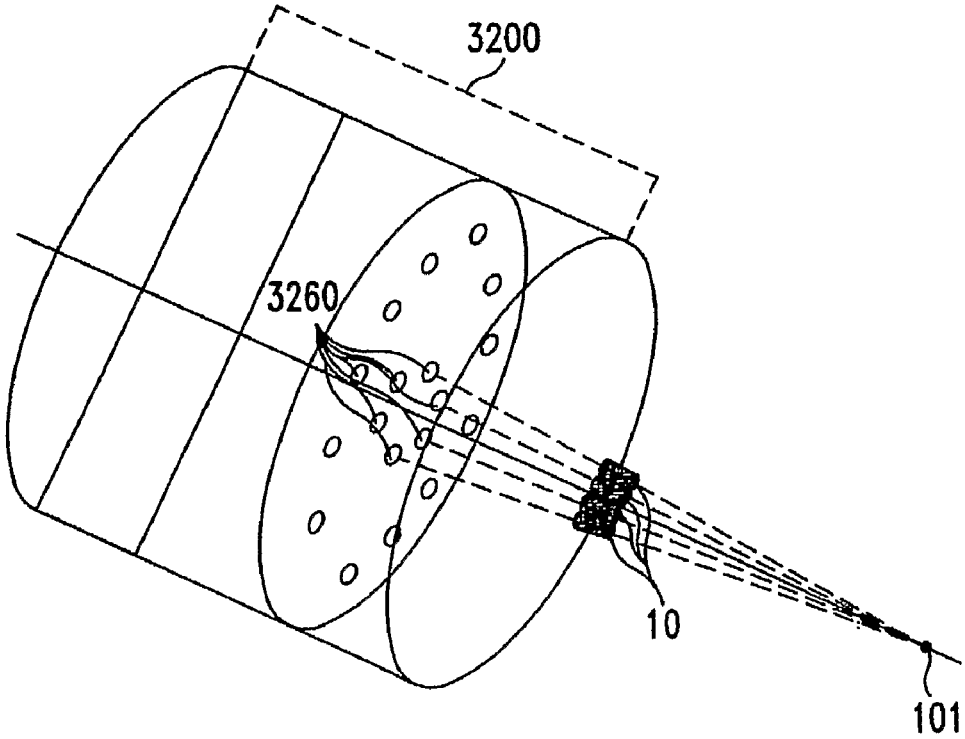

FIG. 9 is an illustration of the borehead of FIGS. 3, 4, and 5 focusing the slugs to maximize boring efficiency.

Figure 10:
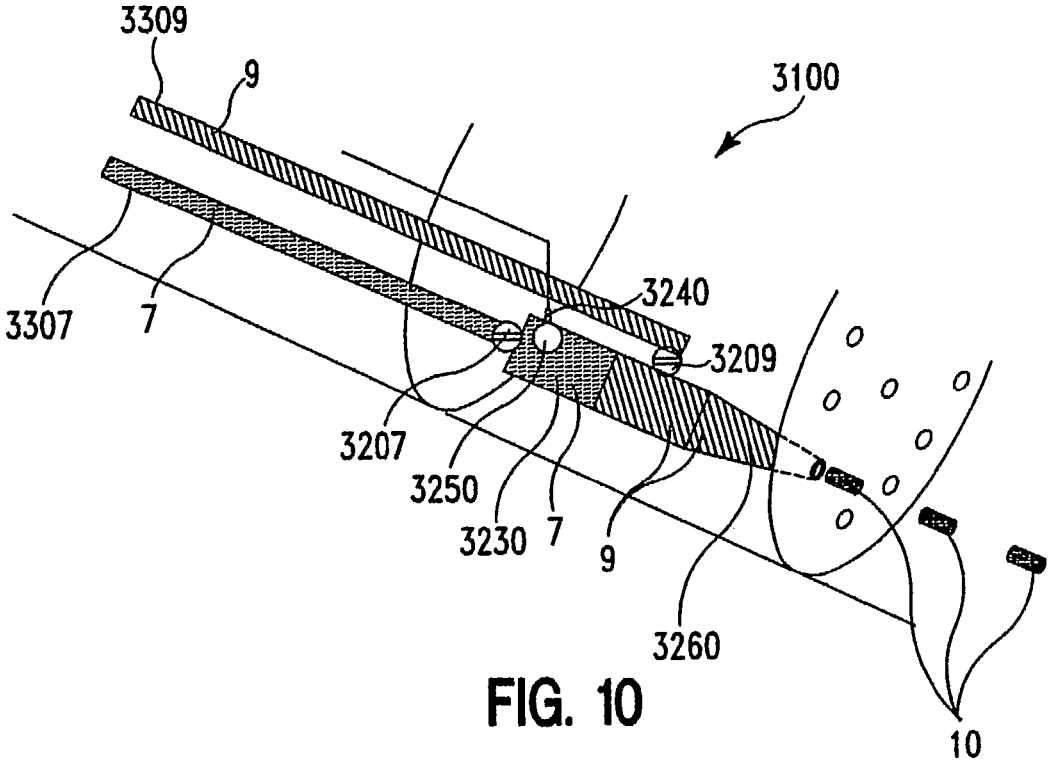

FIG. 10 is an enlarged diagram showing an elevational, cross-sectional diagram of a pulsejet according to another embodiment of the present invention.

Figure 11:
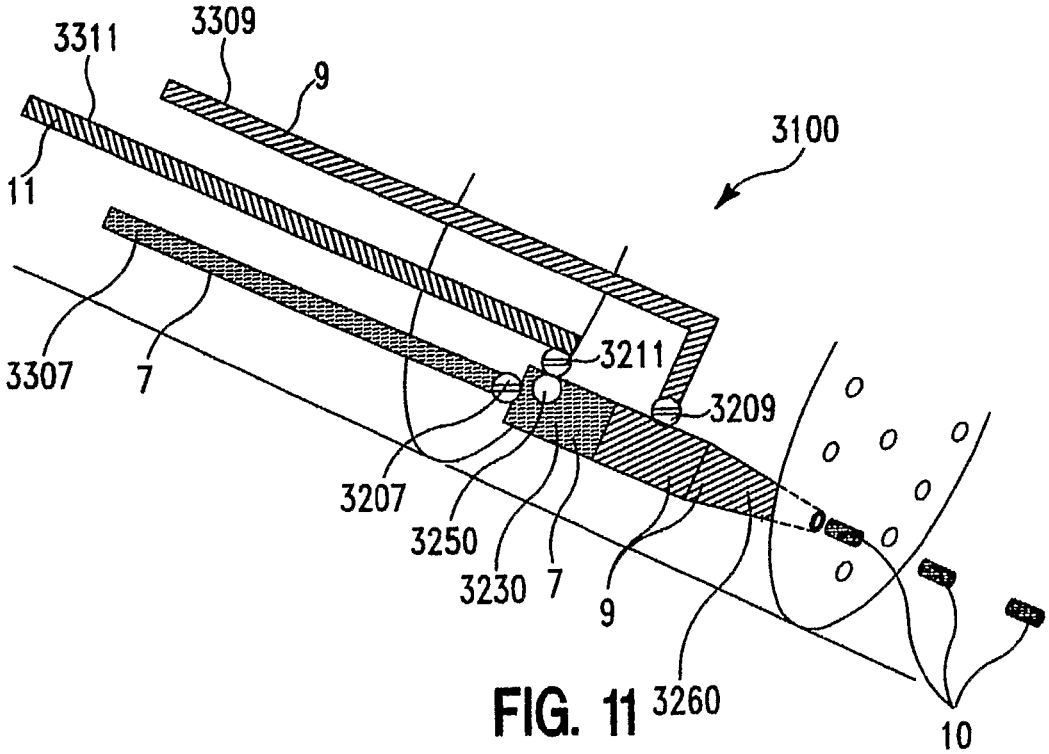

FIG. 11 is an enlarged diagram showing an elevational, cross-sectional diagram of a pulsejet according to another embodiment of the present invention.

Figure 12:
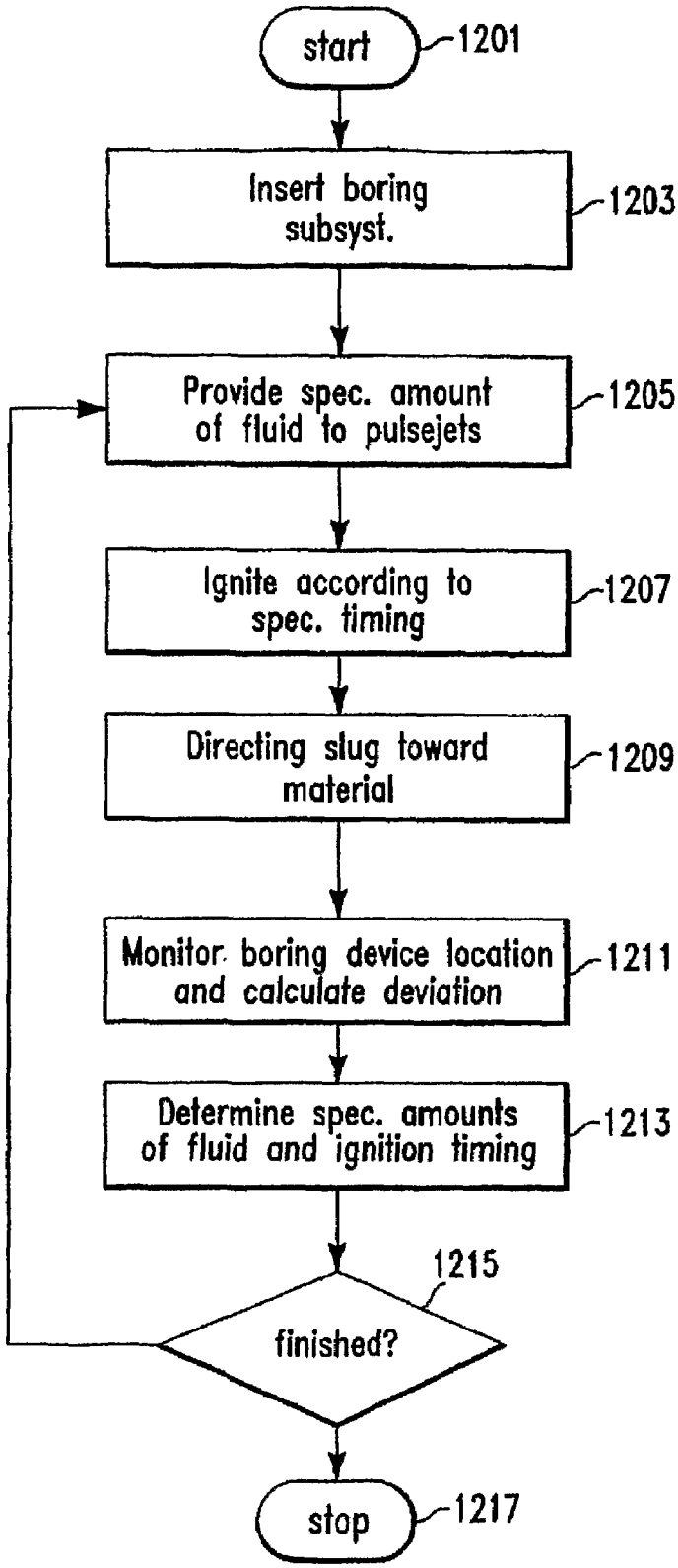

FIG. 12 is a simplified block diagram illustrating the functioning of the present invention.

DETAILED DESCRIPTION OF THE INVENTION

The present invention may be used in connection with the invention described in "System for Rapidly Boring Through Materials" by W. Andrew Berger, Robert A. Spalletta, Jerry A. Carter, Marian Mazurkiewicz, Richard M. Pell, Christopher Davey, filed concurrently with this application. This information is incorporated by reference as if set forth in its entirety herein.

Figure 1:
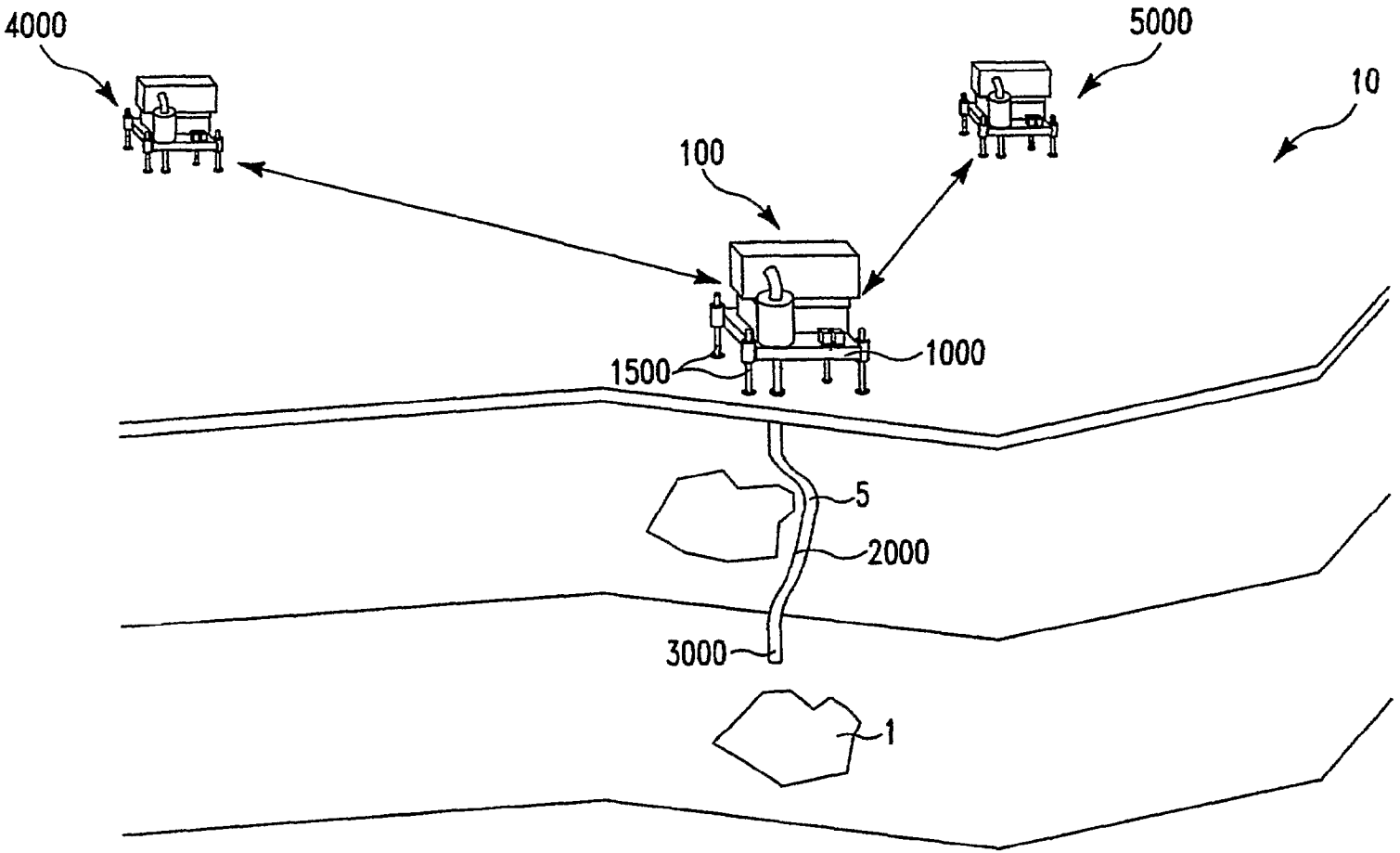
FIG. 1 is a perspective view of one embodiment of several steerable boring devices according to the present invention, as they appear in operation.

In FIG. 1 is a perspective view of one embodiment of the steerable boring device according to the present invention is shown. Here a ground unit 100 is placed just above a target 1 which may be an underground void or object. Ground unit 100 may be delivered there by a number of different conventional known methods including an air-drop for inaccessible locations.

Ground unit 100 employs a platform subsystem 1000 having retention and orientation devices 1500 which secure ground unit 100 to the ground and tilts platform 1000 to an optimum orientation for boring to target 1. Platform subsystem 1000 is designed to hold, store and carry all the equipment during deployment, initiate boring of an access hole, hold materials to be used in a fuel reservoir, stabilize ground unit 100 for boring, and communicate with other units.

A boring subsystem 3000 bores down through the ground toward target 1, creating an access hole 5. Boring subsystem 3000 is designed to force the excavated materials out of the access hole 5 and to the surface.

Boring subsystem 3000 is connected to platform subsystem 1000 by an umbilical subsystem 2000.

Umbilical subsystem 2000 connects the platform 1000 and boring 3000 subsystems. It acts to pass materials, electricity, and control signals between platform 1000 and boring 3000 subsystems.

Umbilical subsystem 2000 also employs mechanical actuators to absorb much of the forces produced during boring, as well as for steering and advancing umbilical subsystem 2000 and boring 3000 subsystems deeper into the access hole 5. Each subsystem is described in greater detail below.

Imaging Devices

Initial imaging of target 1 could be attained by some external underground imaging system and stored in ground unit 100 for later use. The present invention may also use its own active seismic devices to determine the location, depth, and rock properties (structure and seismic velocities) of the target.

Figure 2:
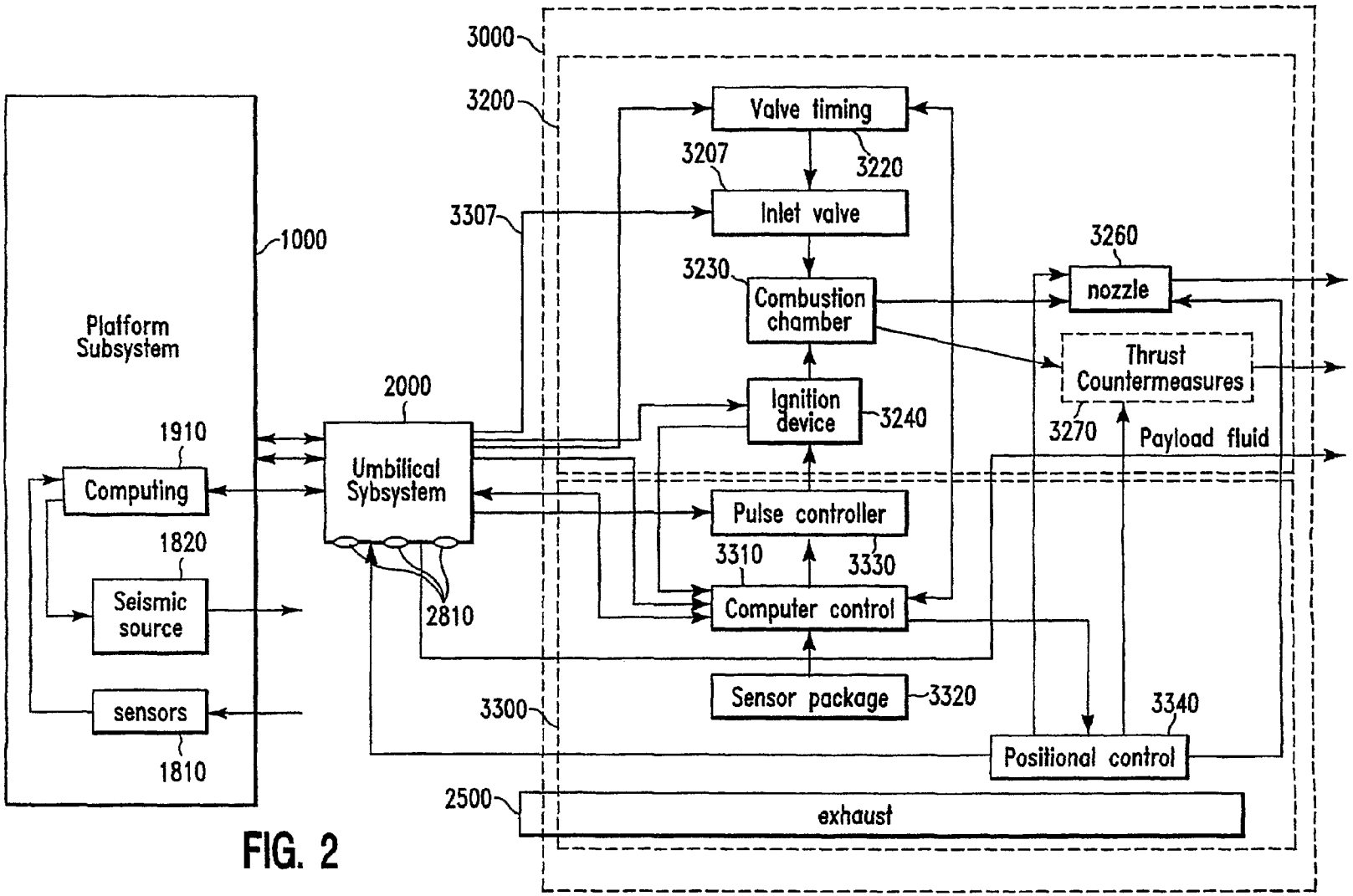
FIG. 2 is a schematic block diagram of the steerable boring device of FIG. 1.

FIG. 2 is a schematic block diagram of the steerable boring device of FIG. 1. An imaging system having a seismic source 1820 and seismic sensors 1810 on platform 1000 are shown. Umbilical sensors 2810 may be attached to umbilical subsystem 2000 which may also act as seismic sensors. A sensor package 3320 in boring subsystem 3000 may also include the seismic sensors.

The seismic source 1820 and seismic sensors 1810, umbilical sensors 2810 and sensor package 3320 are connected (directly or indirectly) to a computing device 1910 on platform 1000.

Seismic output waves are produced by seismic source 1820 and transmitted to the ground over the target area. Echoes are received by sensors 1810, umbilical sensors 2810, and sensor package 3320. There may be several seismic sources 1820 located various positions on the ground, platform 1000 or on the umbilical subsystem 2000. These may be fired in sequence from different locations and readings collected.

Computing device 1910 receives the sensor output, either by hard wire, or via telemetry. Seismic sensors 1810 are mounted at known locations on platform 1000. Also, the umbilical sensors 2810 could also include positional sensors which sense how the umbilical subsystem 2000 is curved and positions of umbilical sensors 2810 along the length of the umbilical subsystem 2000. Therefore all of the sensor readings can be associated with a specific monitoring location.

Seismic signals are generated by a few small ordnance explosions from seismic source 1820. Knowing the positions of the seismic sensors, and reading the data from these sensors, the xyz coordinates could be derived of the underground structures, such as target 1. This would also provide information of the structure and seismic velocities of the ground material, and give an indication of the type of material.

Computing device 1910 then creates an underground image showing the target and other underground features. Computing device 1910 also monitors sensors on boring subsystem 3000 and umbilical subsystem 2000 and superimposes their locations on an underground image created by computing device 1910.

One embodiment of the umbilical 2000 and boring 3000 subsystems according to the present invention is shown in perspective views in FIGS. 3 and 4. Here it can be seen that the umbilical subsystem 2000 is designed to be flexible. Umbilical subsystem 2000 attaches to, and carries boring subsystem 3000 having a plurality of pulsejets 3100 located at its distal end.

Umbilical subsystem 2000 employs a plurality of umbilical actuators 2100 on its periphery, which aid in moving umbilical subsystem 3000 in, or out of access hole (5 of FIG. 1).

Boring Subsystem

FIG. 5 is an enlarged perspective view of one embodiment of a boring subsystem 3000 according to the present invention. The end of the boring subsystem 3000 is a boring head 3200 containing ten to twenty pulsejets 3100. Pulsejets 3100 receive energetic fluid 7, ignite it to cause fluid 7 to create a rapidly expanding bubble 3250 forcing portions of the fluid out of a nozzle 3260 at high speeds as a plurality of fluid slugs 10. Since fluid 7 being used is highly incompressible, each slug 10 creates a significant impact which collectively bore through rock, earth and other materials ahead of nozzle 3260.

Boring head 3200 will likely be constructed from a high tensile strength, high temperature material capable of withstanding significant sand blasting effects. This may be a metal matrix ceramic or other type composite material.

Boring Body

A boring body 3300 behind boring head 3200 protects and houses a pulse controller 3330 for activating igniter 3240 causing the ignition of the energetic fluid 7. It also encloses a sensor package 3320, for sensing physical properties related to the boring subsystem 3000. Boring body 3300 includes a positional control unit 3340 for adjusting the course of the boring head 3200 by adjusting the intensity and sequencing of the firing of pulsejets 3100. Boring body 3300 also includes a computer control 3310.

Computer Control

Computer control 3310 and pulse controller 3330 determine when to ignite the energetic fluid 7. Pulse controller 3330 causes an ignition device 3240 to ignite energetic fluid 7 in a combustion chamber 3230 at the proper instant to cause a slug 10 to be formed and fired out of nozzle 3260.

Computer control unit 3310 will calculate when nozzle 3260 encounters target 1. By sensing physical parameters through sensor package 3320, computer control unit 3310 can detect voids, fluids, etc. in the ground near boring head 3200. This may be based upon the rate of penetration and applied pressures. Computer control unit 3310 will receive data from the sensors in sensor package 3320 and potentially interact with computing device 1910 of platform 1000 to determine the direction which to bore to most effectively reach target 1. Steering may be accomplished by automated analysis of the underground images formed by computing device (1910 of FIG. 2) which chooses a path around obstructions from the current location of borehead 3200 to the target (1 of FIG. 1).

In an alternative embodiment, the computing device (1910 of FIG. 2) is coupled to other units (4000, 5000 of FIG. 1) and/or a command and control unit where a user may view the underground image, the current location of borehead 3200 and the target (1 of FIG. 1), and interactively direct borehead 3200 toward target 1.

FIGS. 6*a*-6*h* are time-sequenced illustrations showing the functioning of pulsejet (3100 of FIG. 5).

Figure 6A:
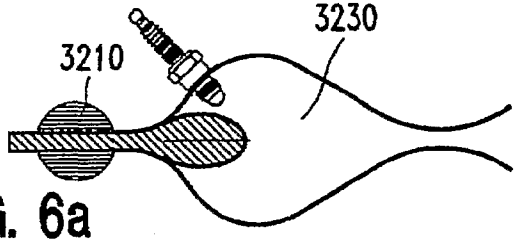

In FIG. 6*a*, energetic fluid 7 passes through open inlet valve 3207 and into combustion chamber 3230. Energetic fluid 7 is illustrated as the light shaded area.

Figure 6B:
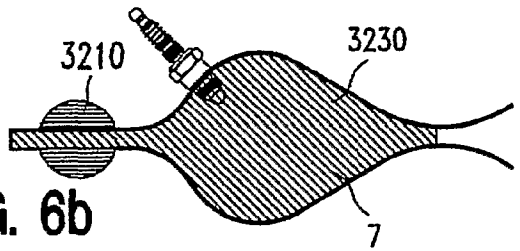

In FIG. 6*b*, inlet valve 3207 is still open as combustion chamber 3230 is filled with energetic fluid 7.

Figure 6C:
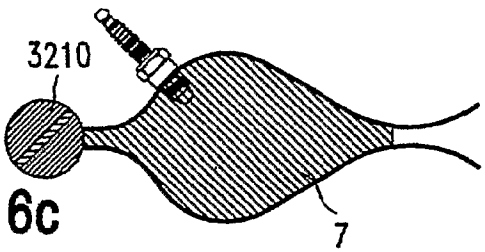

In FIG. 6*c* inlet valve 3207 is closed by computer control (3310 of FIG. 2) driving valve timing device (3220 of FIG. 2).

Figure 6D:
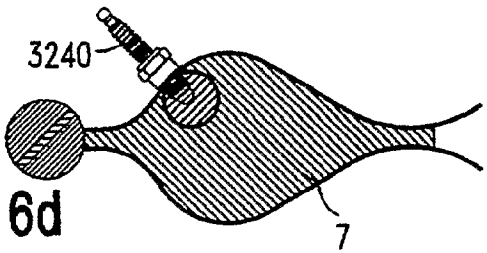

In FIG. 6*d*, ignition device 3240 ignites energetic fluid 7 and creates a rapidly expanding bubble 3250.

Figure 6E:
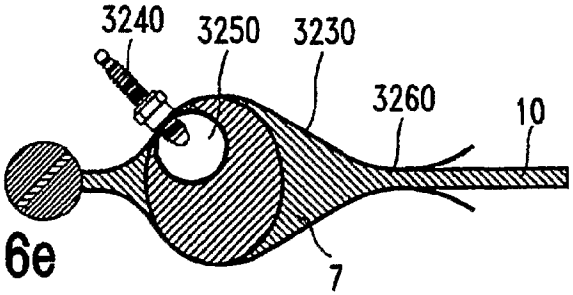

In FIG. 6*e*, bubble 3250 continues to expand, forcing energetic fluid 7 out of nozzle 3260, since there is only one direction to expand, since inlet valve 3207 is closed.

Figure 6F:
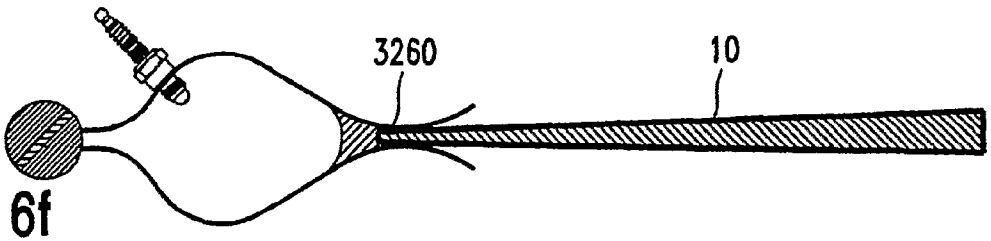

In FIG. 6*f*, almost all of the energetic fluid 7 has been forced out of nozzle 3260 as a high-velocity fluid slug 10.

Figure 6G:
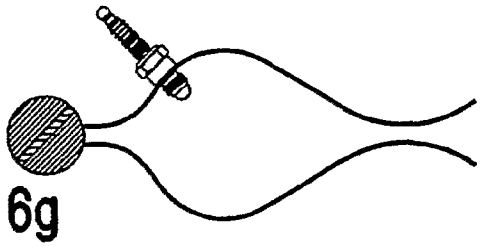

In FIG. 6*g*, a small period of time passes before the cycle is repeated, thereby allowing spacing between fluid slugs 10.

Figure 6H:
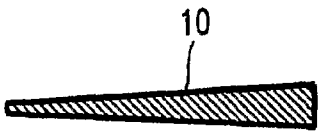
Figure 6H:
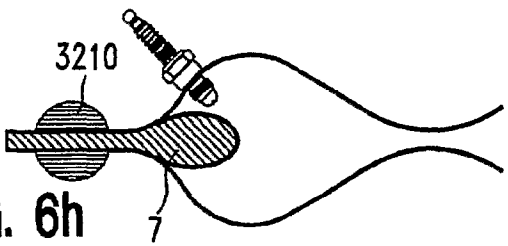

In FIG. 6*h*, inlet valve 3207 is open again beginning the cycle as in FIG. 6*a* above.

FIG. 7 is an illustration of sequencing the slugs to create the effects of rotary boring and maximize boring efficiency. Here, a plurality of pulsejets 3101, 3103, 3105, 3107 and 3109 around the periphery of the borehead are fired in this order creating slugs 10, shown at various distances 31, 33, 35, 37 and 39 from the pulsejets. Computer control (3310 of FIG. 2) notifies pulse controller (3330 of FIG. 2) that a rotary firing is to be performed. Pulse controller (3330 of FIG. 2) then activates ignition device (3240 of FIG. 2) at the proper times to create the sequence as shown. This simulates the effect of a rotary drilling in the direction by the arrows marked "A".

Figure 8A:
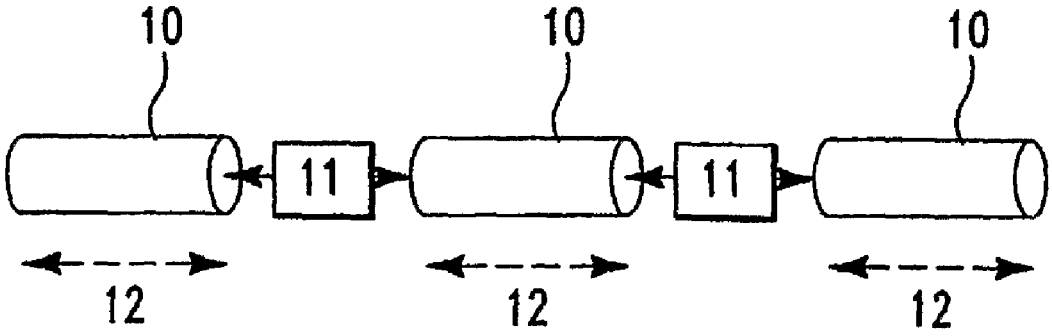
Figure 8B:
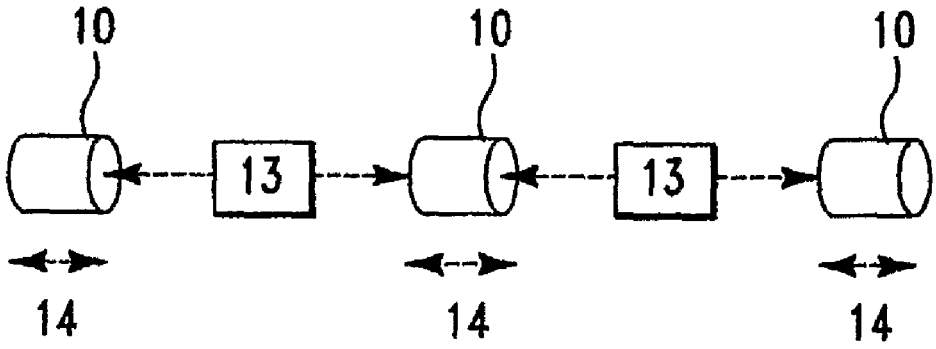
Figure 8C:
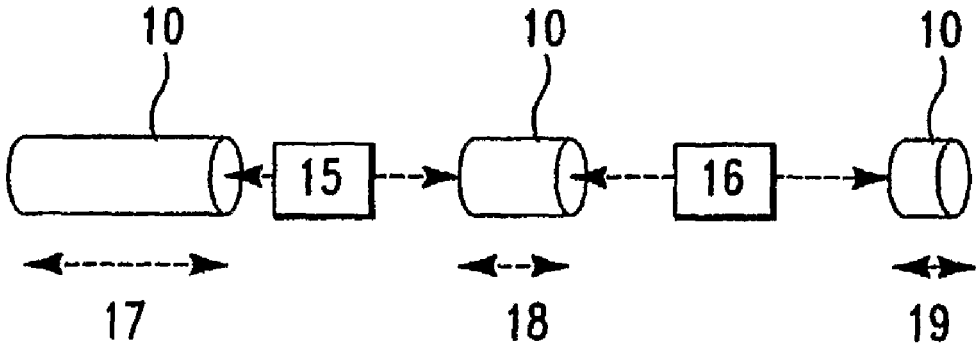

FIGS. 8*a*-8*c* are illustrations of different sized slugs and different spacing between sequential slugs. The computer control, pulse controller, ignition device, valve timing and inlet valve (3310, 3330, 3240, 3220 and 3207 of FIG. 2, respectively) modulate the slug length and slug spacing, thereby varying the pulse jet intensity. These are used not only to steer borehead 3200, but also to be more effective in boring through various types of materials.

In FIG. 8*a* slugs 10 have a consistent length 12 controlled by the computer control identifying the length to valve timing device, operating the inlet valves at the proper timing (3310, 3220 and 3207 of FIG. 2, respectively).

The length of time that the inlet valve (3207 of FIG. 2) is open, the larger the length 12 of slugs 10. The timing of the ignition device (3240 of FIG. 2) determines the spacing 11 between the slugs 10.

In FIG. 8*b*, slug length 14 is much smaller than slug length 12 of FIG. 8*a*, determined by the timing of inlet valve (3207 of FIG. 2).

In FIG. 8*b*, the ignition firing timing is changed to create spacing 13 between slugs 10 which is much larger than spacing 11 between slugs 10 of FIG. 8*a*.

In FIG. 8*c*, both slug length, 17, 18, 19, and slug spacing 15, 16 have been changed in several sequential slugs by adjusting the inlet valve (3207 of FIG. 2) and timing of the firings of ignition device (3240 of FIG. 2).

FIG. 9 is an illustration of focusing the slugs to maximize boring efficiency. Some of the nozzles (3260 of FIG. 2) of the pulsejets may be permanently directed to focus on a focal point 101 ahead of the borehead 3200. This concentrates the impact effects and increases boring capabilities. Alternatively, the nozzles may be moveable and can be focused or otherwise positioned under the control of a positional control (3340 of FIG. 2).

FIG. 10 is an enlarged diagram showing an elevational cross-sectional diagram of a pulsejet according to another embodiment of the present invention. All of the parts with the same numbers function in the same manner as those described earlier in this application with the exceptions to be described below.

In addition to having only a single combustible fluid, the invention now employs another fluid 9. In one embodiment, this fluid is an inert fluid used as to create slugs 10. This is allowed to enter pulsejet 3100 through second valve 3209. Combustible fluid 7 is provided to the combustion chamber 3230 and ignited forcing fluid 9 out of nozzle 3260 as slug 10 with great force.

Since there is little air below the surface, it is difficult to have repeated combustions. Therefore, in an alternative embodiment, fluid 9 may be an oxidizer fluid and the second valve empties into combustion chamber 3230 instead of closer to the nozzle 3260. As fluid 9 is introduced into the combustion chamber 3230, it aids in the combustion by providing oxygen in the combustion chamber 3230. Therefore, ignition device and pulse controller (3240 and 3330 of FIG. 2) now operate second valve controller 3200. These operate to introduce the oxidizer fluid 9 at the proper time into the combustion chamber causing ignition of fluid 7, similar to a pulsed rocket engine.

FIG. 11 is an enlarged diagram showing an elevational cross-sectional diagram of a pulsejet according to another embodiment of the present invention. In this embodiment, both an inert fluid 9 is introduced through a second valve 3209 and an oxidizer fluid 11 is introduced through a third valve 3211. All three valves must be operated in order to cause the proper filling order of the fluids.

FIG. 12 is a simplified block diagram illustrating the functioning of the present invention. The process begins in step 1201.

In step 1203 the boring subsystem is inserted into the material to be bored. Typically, this is the ground. A small explosion may be made or a starter hole drilled by another device to start the process.

In step 1205 a specific amount of combustible is provided to at least one of the pulsejets (3100 of FIG. 5). The first time may be a predefined initial amount. This is done by operating valve (3207 of FIG. 5).

In step 1207, the ignition device (3240 of FIG. 5) is operated to ignite the combustible fluid (7 of FIG. 5). This may be a spark plug type device, an oxidizer injection device, or other conventional ignition devices. This causes a fluid slug to be created and fired from the pulsejet at a specific time, toward the material ahead of the pulsejet, boring through the material.

The nozzles may be permanently pointed at the material, or optionally be movable, and in step 1209 pointed to a specific location.

In step 1211, the boring device monitors the location of the boring device and determines if it is off of a desired path.

In step 1213, it is determined what adjustments should be made to correct the course of the boring device to move to a desired location. This may be by modulating the intensity of the pulsejet firings. The intensity would be modulated by adjusting the size of the slugs and the spacing between the slugs. The firing order may also be adjusted to simulate rotary drilling and other patterns. The amounts of combustible fluids and the firing timing and sequence are determined for each of the pulsejets to correct the direction of the boring.

In step 1215 it is determined if boring is completed, if so ("yes"), then processing stops at step 1217.

If it is decided that boring is not completed ("no"), then steps 1205-1215 are repeated according to the calculations determined in step 1213.

This novel method results in a hole being rapidly bored according to a specified path.

Since other modifications and changes varied to fit particular operating requirements and environments will be apparent to those skilled in the art, the invention is not considered limited to the example chosen for the purposes of disclosure, and covers all changes and modifications which do not constitute departures from the true spirit and scope of this invention.

What is claimed is:

1. A steerable boring device for boring a hole [5] through a material in a desired direction comprising:

a) an umbilical subsystem [2000];

b) a boring subsystem [3000] connected to the umbilical subsystem [2000] having a plurality of pulsejets [3100] for combusting and firing a fluid [7], each pulsejet [3100] having:

i. an inlet [3307] for receiving the combustible fluid [7];

ii. a combustion chamber [3230] in fluid communication with the inlet [3307] for receiving the combustible fluid [7];

iii. a valve [3207] coupled between the inlet [3307] and combustion chamber [3230] for controlling the flow of fluids [7] from the inlet [3307] into the combustion chamber [3230];

iv. a nozzle [3260] fluidically connected to the combustion chamber [3230] for accelerating and pointing fluids escaping from the combustion chamber toward said material;

v. an ignition device [3240] coupled to the combustion chamber [3230] for initiating ignition of the combustible fluid [7] when activated;

c) a controller [3310] for independently activating the valves [3207] and the ignition devices [3240] of the pulsejets [3100], thereby causing at least one pulsejet [3100] to fire with greater intensity than the remaining pulsejets [3100], thereby causing the boring device [3000] to bore a hole in a desired direction.

2. The steerable boring device of claim 1 wherein the pulsejets [3100] are positioned around a perimeter of a borehead [3200] of boring subsystem [3000] and controller [3310] is adapted to fire pulsejets [3100] in sequence around the perimeter thereby simulating rotary drilling.

3. The steerable boring device of claim 1 wherein the controller [3310] is adapted to repeatedly activate the ignition devices [3240] so as to cause various sized slugs to be created and rapidly forced out of the nozzles [3260].

4. The steerable boring device of claim 1 wherein the controller [3310] is adapted to repeatedly activate the ignition devices [3240] so as to cause various sized spacing [11,13, 15,19] between the slugs [10] to be created as the slugs [10] are rapidly forced out of the nozzles [3260].

5. The steerable boring device of claim 1 wherein the controller [3310] is adapted to repeatedly activate the inlet valves [3207] so as to cause various sized slugs [10] to be created as the slugs [10] are rapidly forced out of the nozzles [3260].

6. The steerable boring device of claim 1 wherein a plurality of nozzles [3260] can be aimed to focus the slugs [10] to a desired location [101].

7. The steerable boring device of claim 1 further comprising:

a) an inert fluid;

b) a second valve [3209] capable of providing, or stopping the flow of the inert fluid into the pulsejet [3100]; the c) controller adapted to operate second valve [3209] to cause inert fluid [9] to enter the pulsejet [3100] but to stop inert fluid [9] from flowing back into second valve [3209], and to be expelled from the nozzle as part of a slug [10] when the pulsejet [3100] is fired.

8. The steerable boring device of claim 1, wherein the ignition device comprises:

a. an oxidizer fluid [11];

b. a third valve [3211] capable of providing, or stopping the flow of the oxidizer fluid [11] into the pulsejet [3100]; the c. controller adapted to operate third valve [3211] to cause oxidizer fluid [11] to enter the pulsejet [3100] at the proper ignition timing so as to cause the pulsejet [3100] to fire.

9. The steerable boring device of claim 8, wherein the ignition device comprises:

a) an oxidizer fluid [11];

b) a third valve [3211] capable of providing, or stopping the flow of the oxidizer fluid [11] into the pulsejet [3100]; and c) the controller adapted to operate third valve [3211] to cause oxidizer fluid [11] to enter the pulsejet [3100] at the proper ignition timing so as to cause the pulsejet [3100] to fire.

10. A method of steering a boring device through a material comprising the steps of:

a) inserting [1203] a boring subsystem [3000] into said material having a plurality of pulsejets [3100] of a borehead [3200] each capable of igniting combustible fluid [7]; and b) loading a plurality of pulsejets [3100] with combustible fluid [7]; and c) firing the combustible fluid [7] in a plurality of the pulsejets [3100] with differential firing intensities so as to cause the borehead [3200] to turn in a desired direction.

11. The method of steering of claim 10 further comprising the steps of:

a) monitoring [1211] the location of the boring subsystem [3000] and its deviation from said desired path;

b) calculating a firing intensity for each of the pulsejets [3100] to correct the deviation from said desired path; and c) firing [1207] each of the pulsejets [3100] with the calculated firing intensity so as to correct the deviation from the desired path.

12. The method of steering of claim 10 wherein calculating a firing intensity comprises:

calculating [1213] an amount of combustible fluid [7] and ignition timing to be provided to each of the pulsejets [3100] to cause the pulsejets [3100] to fire with the calculated firing intensity.

13. The method of steering of claim 10 wherein firing the pulsejets [3100] comprises the steps of:

Igniting [1207] the calculating amount of combustible fluid [7] at the calculated ignition timing to cause the pulsejets [3100] to correct the deviation from the desired path.

14. The method of steering of claim 13 wherein the ignition timing is calculated to fire the pulsejets [3100] in sequence in a circular order around the borehead [3200] thereby simulating rotary drilling.

15. The method of steering of claim 10 wherein the step of calculating a firing intensity comprises the steps of:

calculating amounts of combustible fluid [7] and ignition timing to be provided to each of the pulsejets [3100] to cause the pulsejets [3100] to fire a plurality of spaced fluid slugs [10] each having a specific length and spacing behind a previous slug [10] sequentially fired out of the pulsejets [3100] at said material.

16. The method of steering of claim 15, wherein the step of calculating comprises the steps of:

varying the calculated amounts of combustible fluid [7] to vary the length of the slugs [10].

17. The method of steering of claim 15, wherein the step of calculating comprises the steps of:

varying the ignition timing so as to vary the spacing between the slugs [10].

18. The method of steering of claim 15, wherein the step of calculating comprises the steps of:

a) varying the calculated amount of combustible fluid [7] to vary the length of the slugs [10]; and b) varying the ignition timing so as to vary the length of the slugs [10].

19. The method of steering of claim 15, wherein the step of calculating comprises the steps of:

varying the firing sequence so as to vary the drilling effect.

20. The method of steering of claim 13, wherein the step of igniting comprises the step of:

introducing an oxidizer [11] into the pulsejet [3100] to cause combustion of the combustible fluid [7].

* * * * *